United States Patent [19]

Culbertson

[11] 4,142,660

[45] Mar. 6, 1979

[54] CABINET LATCH ASSEMBLY

[75] Inventor: Richard Culbertson, Manlius, N.Y.

[73] Assignee: General Electric Company, Syracuse, N.Y.

[21] Appl. No.: 799,396

[22] Filed: May 23, 1977

[51] Int. Cl.[2] ..... A45F 5/10

[52] U.S. Cl. ..... 224/45 P; 16/114 R; 24/230 R; 403/329

[58] Field of Search ..... 224/45 R, 45 P; 24/201 A, 230 R; 16/150, 110 R, 110 S, 114 R, 114 B; 403/353, 329

[56] References Cited

U.S. PATENT DOCUMENTS

| | | | |
|---|---|---|---|
| 2,600,708 | 6/1952 | Ulrich | 16/110 R X |
| 3,365,756 | 1/1968 | Bayon | 24/201 A |

FOREIGN PATENT DOCUMENTS

| | | | |
|---|---|---|---|
| 239635 | 10/1911 | Fed. Rep. of Germany | 24/230 SL |

*Primary Examiner*—Francis S. Husar
*Assistant Examiner*—D. W. Underwood
*Attorney, Agent, or Firm*—Carlos Nieves; George R. Powers; Leonard J. Platt

[57] ABSTRACT

A quick release latch assembly for a portable cabinet, such as that of a tape player, for providing ready attachment and release of a carry strap or like accessory to said cabinet. The latch assembly comprises a fixed member integrally constructed with said cabinet having a pair of angled grooves and resilient tongue means, and a removable member including a lower portion having a pair of pivot rod ends and an upper portion having means for coupling to the carry strap, the rods ends inserting into the grooves when the tongue is depressed and upon reaching beyond the angled corners of the grooves being held in position by said tongue abutting the lower portion of said removable member.

7 Claims, 6 Drawing Figures

CABINET LATCH ASSEMBLY

BACKGROUND OF THE INVENTION

The invention relates generally to the field of latch mechanisms and, in particular, to quick release mechanisms of this type useful for coupling a strap or like accessory to a portable device, such as for attaching a carry strap to a tape player. In the past, latch mechanisms with several fixed and moving parts have been employed for providing a quick latch and release operation. These latch mechanisms are normally constructed as separate structures from that of the portable device. Thus, they are relatively complex and expensive structures. In addition, these mechanisms are of relatively rigid construction and require additional support structure to avoid being broken or damaged by ordinary use.

SUMMARY OF THE INVENTION

It is accordingly an object of the invention to provide a novel cabinet latch assembly for coupling a strap or like accessory to a portable tape player or like device that provides quick latch and release operation and is of simple and inexpensive construction.

It is a further object of the invention to provide a novel cabinet latch assembly as above described that is of integral construction with the cabinet of the portable device.

It is another object of the invention to provide a novel cabinet latch assembly as above described that is constructed to withstand relatively hard use.

These and other objects of the invention are accomplished by a cabinet latch assembly for attaching a carry strap or like accessory to a portable tape player device or like device, which latch assembly is comprised of a fixed member integrally constructed with the cabinet of said device having a pair of angled grooves in the side walls of said member and a resilient tongue means that extends laterally between said grooves. The grooves have a first tapered section that extend inwardly to angled corners and a second section that extend upwardly. The tongue moves between the upper, unstressed position and a lower, stressed position. The latch assembly further comprises a removable member having a lower portion with a pair of pivot rod ends and an upper portion with means for coupling to the carry strap, the rod ends inserting into the grooves with the tongue in its lower, stressed position and upon reaching beyond the angled corners of the grooves are held in place within the grooves by the tongue in its upper, unstressed position abutting the lower portion of said removable member.

BRIEF DESCRIPTION OF THE DRAWING

While the specification concludes with the claims which particularly point out and distinctly define that subject matter which is regarded as the invention, it is believed the invention will be more clearly understood when considering the following detailed description and the accompanying figures of the drawing in which:

DESCRIPTION OF THE PREFERRED EMBODIMENT

Figure 1:
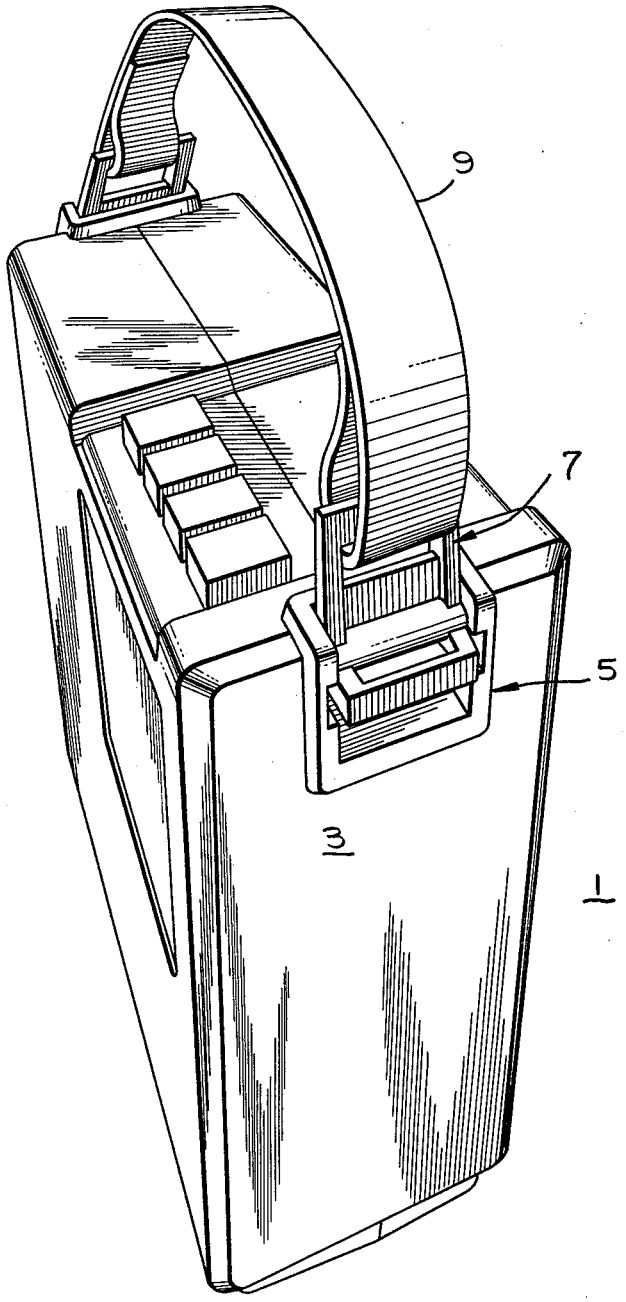
FIG. 1 is a perspective view of a tape player which embodies the cabinet latch assembly of the present invention.

Referring to FIG. 1, there is illustrated in perspective view a tape player 1 which embodies the cabinet latch assembly 3 of the present invention. The latch assembly is composed of a fixed member 5 constructed integrally with the cabinet structure of the tape player and a removable member 7, the assembly providing a quick latch and release of a carry strap 9 to the tape player 1. The fixed member 5 is made of the same material as the cabinet, typically a polystyrene material.

Figure 2:
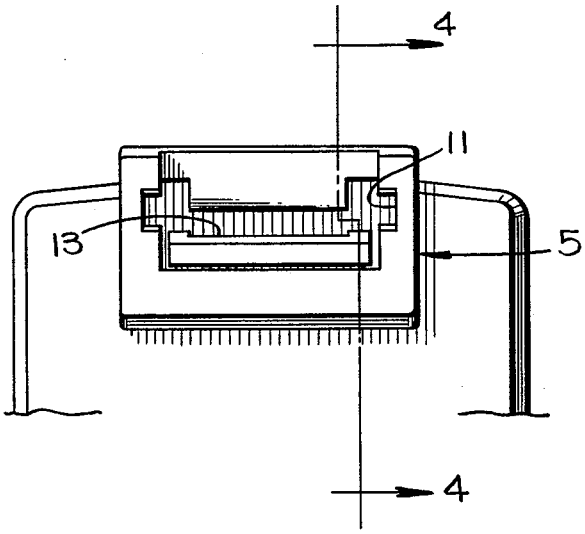
FIG. 2 is a front view of the fixed member of the cabinet latch assembly.
Figure 4:
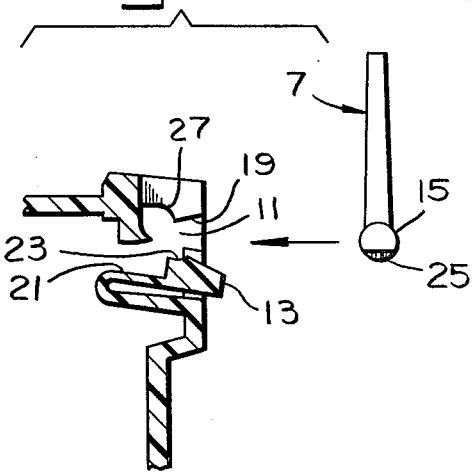
FIG. 4 is a cross-sectional view of the fixed member of the cabinet latch assembly taken along the line 4—4 in FIG. 2, and a side view of the removable member.
Figure 5:
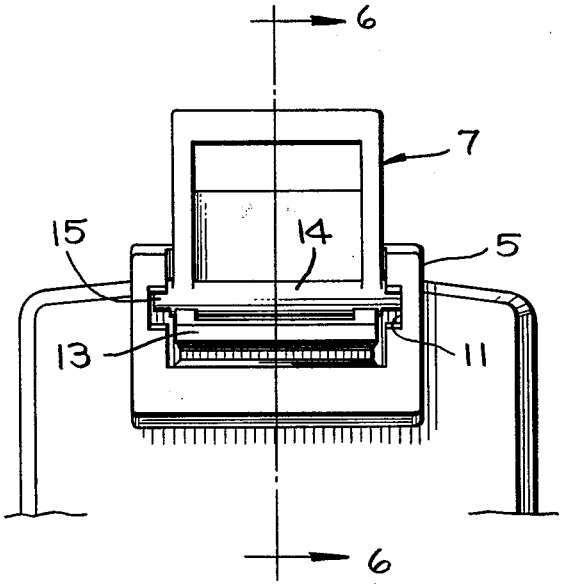
FIG. 5 is a front view of the composite cabinet latch assembly.

As shown in FIG. 2, which is a front view of the fixed member 5, and FIG. 4, which shows a cross-sectional view of the fixed member taken along the line 4—4, formed in the side walls of the member 5 are a pair of angled grooves 11. The member 5 further includes a resilient tongue means 13 that is movable in the vertical direction between an upper, unstressed position and a lower, stressed position, the latter being shown in FIGS. 2 and 4. FIG. 5 illustrates a front view of the composite cabinet latch assembly with the tongue 13 in its upper, unstressed position.

Figure 3:
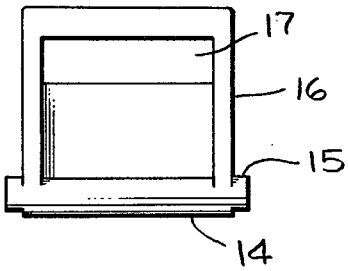
FIG. 3 is a front view of the removable member of the cabinet latch assembly.

A front view of the removable member 7, in the form of a bail pivot, is illustrated in FIG. 3. The bail pivot comprises a lower portion 14 with a pair of rod ends 15 and an upper portion 16 with an aperture 17 for coupling to the carry strap.

As shown in FIG. 4, the grooves 11 have a first section that extend inwardly, generally in the horizontal direction, with narrowing tapered sides 19. Beyond the narrowest point of the taper, the grooves angle upwardly generally in the vertical direction. The resilient tongue 13 is constructed as a U shaped member, its upper leg being hinged with respect to its lower leg. The tongue has a greater thickness at its edges for strength than in its interior portion which is reduced to the dimension shown at 21 to give it a resilience corresponding to a spring tension of several pounds. The tongue has a seating surface 23 for pressing against the bail pivot when it is fully engaged.

The pivot rod ends 15 are primarily of circular cross-section, with a flat bottom surface 25, shown in the side view of the bail pivot 7 in FIG. 4. The flat bottom surface provides a partial diameter in the vertical direction having a dimension less than the width at the narrowest point of the tapered grooves 11, so that the rod ends 15 can pass through the grooves beyond the angled corners when the bail pivot is vertically aligned. It can be similarly removed when in this alignment. In contrast, the full diameter of the rod ends is greater than the narrowest point of the tapered grooves so that the rod ends cannot pass through this point other than when the bail pivot is vertically aligned.

With the tongue 13 in the lower, stressed position and the bail pivot 7 aligned in the vertical direction, the bail pivot can be engaged within the fixed member 5 by inserting the rod ends 15 into the grooves 11. Upon reaching beyond the angled corners of the grooves, the rod ends are moved upwardly through pressure exerted by the tongue 13 which acts to snap the rod ends in place. The bail pivot thereafter remains locked into place by the tongue in its upper, unstressed position abutting the lower portion 14.

Figure 6:
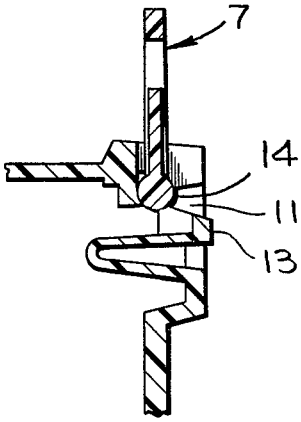
FIG. 6 is a cross-sectional view of the composite cabinet latch assembly taken along the line 6—6 in FIG. 5.

The engaged position of the bail pivot 7 with the fixed member 5 of the latch assembly is clearly shown in the front view of FIG. 5 and the cross-sectional view of FIG. 6, which is taken along the line 6—6 in FIG. 5. The surface of the lower portion 14 of the bail pivot, the seating surface 23 and the groove surface 27 beyond the angled corner are curved so that in this position the bail pivot can be freely rotated through approximately 135°. By being so rotatable it is less likely to become broken or damaged during handling. As a further advantage, the bail pivot can be removed only when it is in vertical alignment and the tongue 13 is fully depressed into its lower, stressed position. There is accordingly provided a secure latching of the bail pivot to the fixed member that will not become disengaged unintentionally.

Although the invention has been described with respect to a specific operable embodiment for purposes of full and clear disclosure, the appended claims are intended to extend to all modifications and changes that may reasonably be said to fall within the invention's true scope.

What I claim as new and desire to secure by Letters Patent of the United States is:

1. A cabinet latch assembly for providing ready attachment and release of a carry strap or like accessory to a portable cabinet, comprising:

(a) a fixed member having side walls including, (1) a pair of angled grooves, one formed in each side wall of said member, said grooves having a first section that extends inwardly to angled corners, and a second section that extends upwardly, (2) resilient tongue means which extends laterally between said grooves and is hinged to move between an upper, unstressed position and a lower, stressed position, and (b) a removable member for releasably engaging said fixed member including a pair of rod ends that insert into said grooves with said tongue depressed into its lower, stressed position and are held in place by said tongue member moving into its upper, unstressed position, said rod ends being held in place when resting in said second sections.

2. A cabinet latch assembly as in claim 1 in which the first sections of said grooves have narrowing tapered sides, the narrowest point being at said angled corners, and said rod ends have a flat bottom surface so as to provide a partial diameter in the vertical direction for said rod ends that is less than the width at the narrowest point of said grooves, and a full diameter for said rod ends that is greater than the width at said narrowest point, whereby the removable member can be fully engaged and disengaged with respect to said fixed member only when in a vertical alignment.

3. A cabinet latch assembly as in claim 2 in which said removable member has a lower portion which includes said rod ends and an upper portion which includes means for coupling to said carry strap or accessory.

4. A cabinet latch assembly as in claim 3 in which said tongue has a seating surface which abuts the lower portion of said removable member when said removable member is fully engaged with said fixed member.

5. A cabinet latch assembly as in claim 4 in which said seating surface, the surface of said lower portions and the surface of the second section of said grooves are curved so as to provide free rotation of said removable member when in its fully engaged position.

6. A cabinet latch assembly as in claim 5 in which said fixed member is integrally constructed with said portable cabinet.

7. A cabinet latch assembly as in claim 6 in which fixed and removable members are constructed of a plastic material.

* * * * *